US007399099B2

(12) United States Patent
Stokes

(10) Patent No.: US 7,399,099 B2
(45) Date of Patent: Jul. 15, 2008

(54) ILLUMINATED TRAFFIC DIRECTING GLOVES

(75) Inventor: John H. Stokes, Dripping Springs, TX (US)

(73) Assignee: Tactical Devices, Inc., Austin, TX (US)

( * ) Notice: Subject to any disclaimer, the term of this patent is extended or adjusted under 35 U.S.C. 154(b) by 0 days.

(21) Appl. No.: 11/775,670

(22) Filed: Jul. 10, 2007

(65) Prior Publication Data

US 2008/0007427 A1 Jan. 10, 2008

Related U.S. Application Data

(60) Provisional application No. 60/819,596, filed on Jul. 10, 2006.

(51) Int. Cl.
*F21V 33/00* (2006.01)

(52) U.S. Cl. ..... 362/103; 362/802; 2/161.6; 2/160

(58) Field of Classification Search ..... 362/103, 362/109, 253, 802; 2/16, 159, 161.6, 160
See application file for complete search history.

(56) References Cited

U.S. PATENT DOCUMENTS 1,630,730 A * 5/1927 Daugherty ..... 116/35 R
5,424,922 A * 6/1995 Wise ..... 362/554
5,898,942 A * 5/1999 Anderson ..... 2/159
6,006,357 A * 12/1999 Mead ..... 2/160
6,709,142 B2 * 3/2004 Gyori ..... 362/554
6,711,746 B1 * 3/2004 Orellana ..... 2/160
6,976,274 B1 * 12/2005 Dufresne ..... 2/161.6
2004/0128736 A1 * 7/2004 Raz et al. ..... 2/159
2004/0255361 A1 * 12/2004 Senter et al. ..... 2/160
2006/0109645 A1 * 5/2006 Ferrari et al. ..... 362/103
2006/0139911 A1 * 6/2006 Wilkings ..... 362/103
2007/0076408 A1 * 4/2007 Abas ..... 362/103

* cited by examiner

*Primary Examiner*—Laura Tso
(74) *Attorney, Agent, or Firm*—Craig J. Yudell; Dillon & Yudell LLP

(57) ABSTRACT

A hand-held apparatus for directing the flow of traffic is disclosed. The palm side of a glove includes multiple high intensity red light emitting diodes (LEDs), and the back side of the glove includes multiple high intensity green LEDs. A control circuit coupled to the red and green high intensity LEDs periodically monitors the state of a motion and position sensor. When the state of the motion and position sensor corresponds to the palm side of the glove being in a vertical position with multiple fingers of the glove pointing skyward to within an acceptance angle of vertical relative to the ground, the control circuit illuminates the high intensity red LEDs. When the state of the motion and position sensor corresponds to the palm side of the glove not being in a vertical position relative to the ground, the control circuit illuminates the high intensity green LEDs.

20 Claims, 7 Drawing Sheets

ILLUMINATED TRAFFIC DIRECTING GLOVES

PRIORITY CLAIM

Benefit of priority under 35 U.S.C. §119(e) is claimed based on U.S. Provisional Application No. 60/819,596, entitled, "Illuminated Traffic Directing Gloves," filed on Jul. 10, 2006, which disclosure is incorporated herein by reference.

BACKGROUND OF THE INVENTION

1. Technical Field

The present invention relates in general to electronic devices and in particular to hand-held devices. Still more particularly, the present invention relates to an improved hand-held apparatus for directing the flow of traffic.

2. Description of the Related Art

Prior art in the field of traffic directing devices typically consists of one of the following: (a) a flashlight, (b) a flashlight having a translucent red cone on the end, (c) gloves with reflective tape and/or markings, and (d) gloves illuminated via low intensity Light Emitting Diodes (LEDs) that are monochromatic and suitable for operation only at night.

The aforementioned flashlights with translucent red cones may cause driver confusion since the red cones are constantly illuminated, thereby requiring the driver to determine whether to stop or proceed based solely on the motion of the illuminated red cone. Similarly, gloves with reflective tape and/or markings may also cause driver confusion since the color of the light reflected from the gloves is constant and the attributes of the reflected light are controlled passively, as a function of the material characteristics of the reflective tape and/or markings. The aforementioned gloves illuminated via low intensity LEDs are too dim to be seen by drivers during the day. Furthermore, gloves illuminated via low intensity LEDs are monochromatic and are constantly turned on (unless turned off via a manual on/off switch), which may cause driver confusion and/or inhibit the free movement of both hands of the user of the gloves (due to the necessity of manually operating the on/off switch).

SUMMARY OF AN EMBODIMENT

Disclosed is a hand-held apparatus for directing the flow of traffic. Preferred embodiments provide a method and system for enhanced traffic direction through the use of a pair of gloves equipped with both red and green high intensity Light Emitting Diodes (LEDs). Selective operation of the red and green high intensity LEDs removes ambiguity from the corresponding hand motions and allows operation of the gloves in both daytime and nighttime settings. Each glove includes multiple red high intensity LEDs, multiple green high intensity LEDs, a motion and position sensor, a microcontroller, multiple power Metal Oxide Semiconductor Field Effect Transistors (MOSFETs), and a battery. A pair of gloves may be equipped with red high intensity LEDs on each palm. Similarly, the back of each glove may be equipped with greed high intensity LEDs. If the wearer's hand is sensed to be moving in a back and forth motion, the green LEDs on the back side of the glove are turned on and the red LEDs on the palm are turned off, thereby indicating that the vehicle traffic should proceed. If the hand is held with the palm facing outward relative to the body of the user and the fingers pointing up, the red LEDs on the palm are turned on and the green LEDs on the back side are turned off, thereby indicating that the vehicle traffic should stop. During normal operation, one glove of the user would be capable of signaling stop while the other glove of the user would be capable of signaling go, and vice-versa.

The above as well as additional objectives, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

Figure 1A:
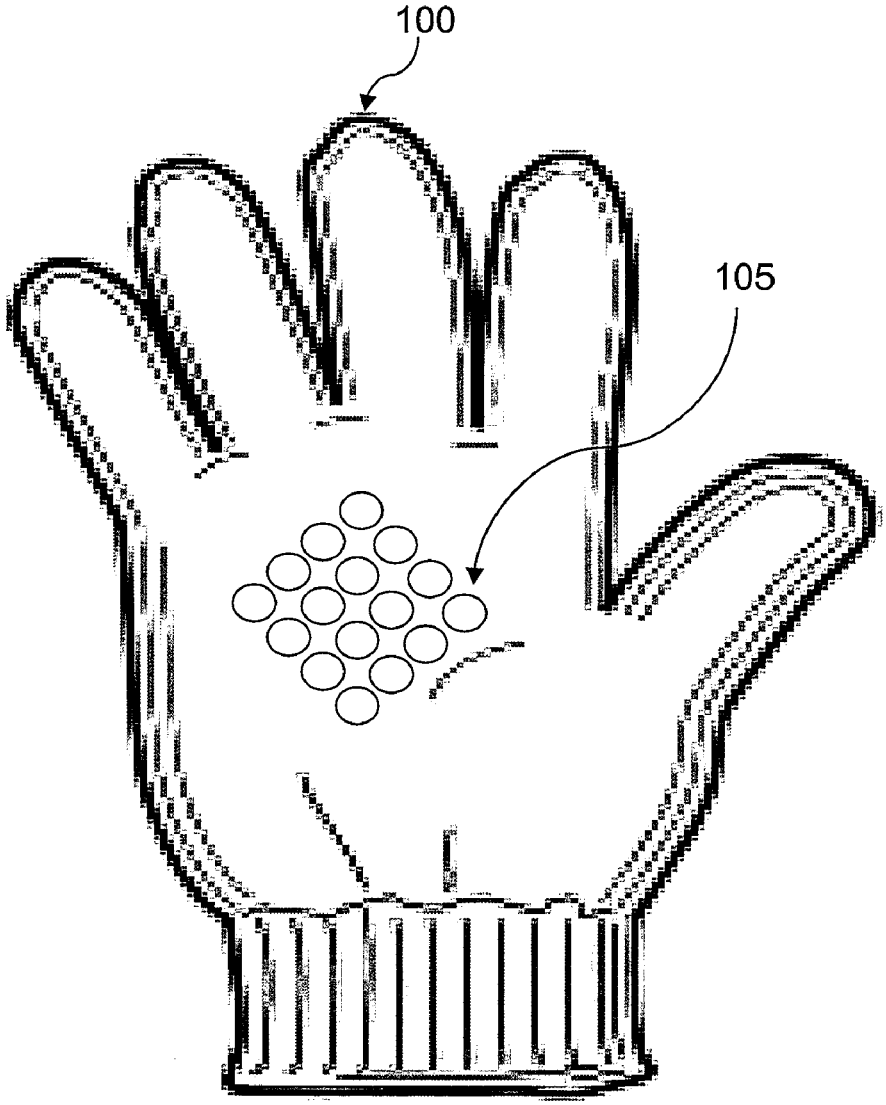
FIGS. 1A-1B depict a glove having red LEDs on the front/palm surface and green LEDs on the back surface, respectively, according to a preferred embodiment of the invention.

This invention is described in a preferred embodiment in the following description with reference to the figures, in which like numbers represent the same or similar elements. Within the descriptions of the figures, similar elements are provided similar names and reference numerals as those of the previous figure(s). Where a later figure utilizes the element in a different context or with different functionality, the element is provided a different leading numeral representative of the figure number (e.g., 1xx for FIG. 1 and 2xx for FIG. 2). The specific numerals assigned to the elements are provided solely to aid in the description and not meant to imply any limitations (structural or functional) on the invention.

DETAILED DESCRIPTION OF AN ILLUSTRATIVE EMBODIMENT

Figure 1B:
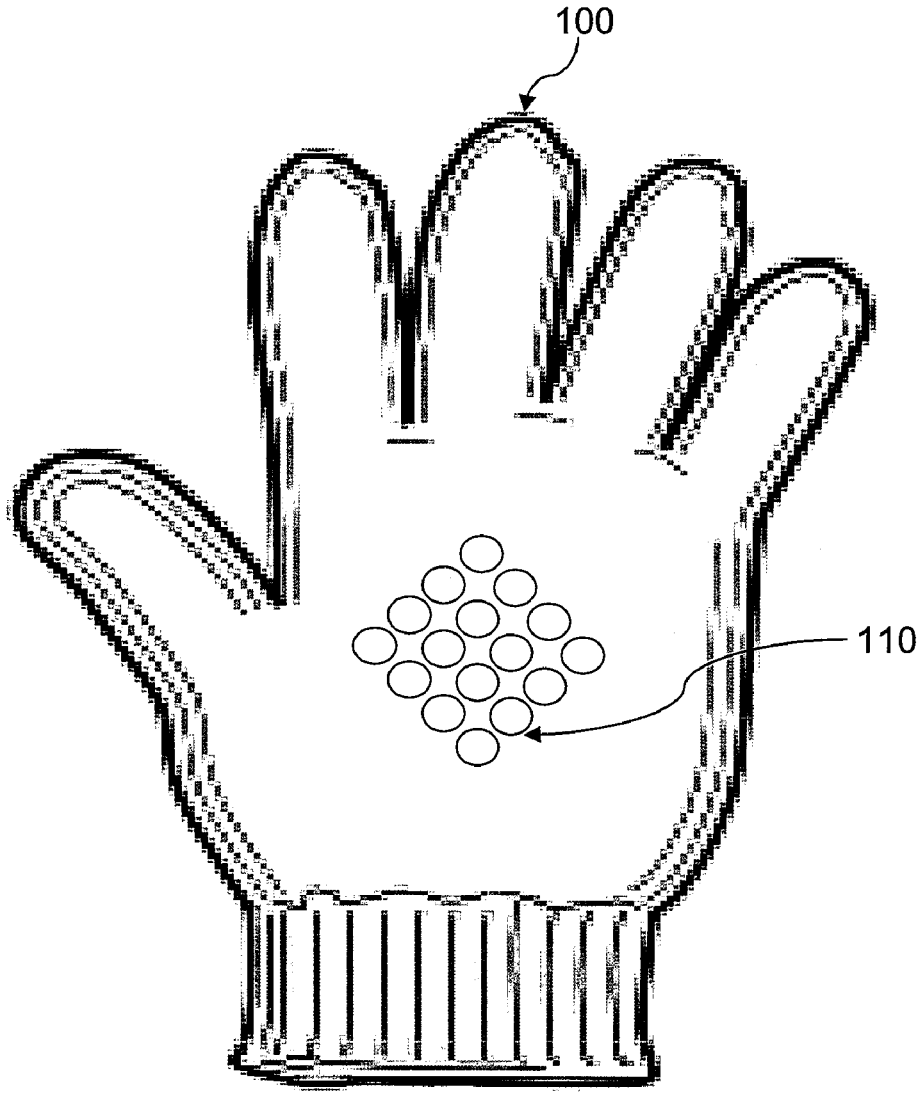

The embodiments of the present invention provide a hand-held electronic apparatus for directing the flow of traffic. With reference to FIG. 1A, there is depicted a simplified diagram of a right handed glove 100 in accordance with one preferred embodiment of the present invention. Glove 100 includes multiple red high intensity Light Emitting Diodes (LEDs) 105 attached to the surface of glove 100 on the front/palm side of glove 100 with respect to the user. Similarly, FIG. 1B depicts a simplified diagram of the back surface of glove 100, which includes multiple green high intensity LEDs 110 attached to the back surface of the glove with respect to the user.

While the figures generally depict a single right handed glove, the use of a single right handed glove in the figures is provided solely to aid in the description and not meant to imply any limitations (structural or functional) on the invention. For example, the invention may be implemented using two independent and similarly configured gloves, on both the right and left hands. The invention may also be implemented with red LEDs on the back side of the gloves and with green LEDs on the front/palm side of the gloves. Similarly, red and/or green LEDs may entirely cover one or both gloves or halves thereof. Moreover, the mounting structure for the traffic-directing apparatus can be a glove, mitt, strap, stick, flashlight, plate, paddle or other hand-held or mounted device.

Figure 2:
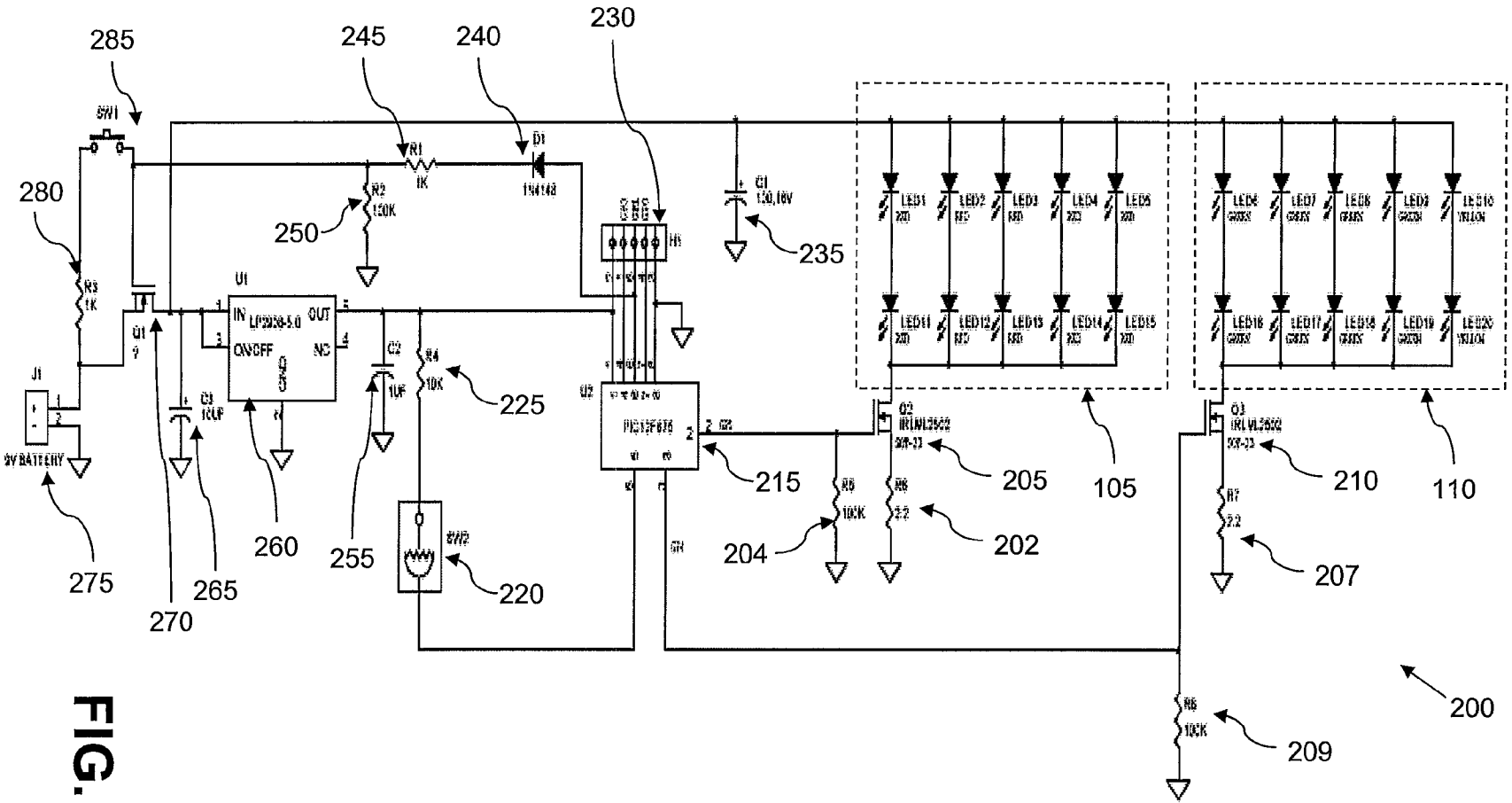
FIG. 2 depicts a schematic of an electronic circuit according to a preferred embodiment of the invention.

With reference now to FIG. 2, there is depicted a schematic of an electronic circuit for operation of a traffic-directing glove in accordance with an embodiment of the present invention. As shown, glove 100 may include a control circuit on a flexible printed circuit board (PCB) 200. In one embodiment, flexible PCB 200 may cover the palm of the glove, wrap around the outside edge of the glove (i.e. the edge opposite the thumb), and cover the back side of the glove (i.e. opposite the palm). Multiple red high intensity LEDs 105 may be attached to flexible PCB 200 in a manner so as to provide a matrix pattern on the palm. Similarly, a plurality of green high intensity LEDs 110 may be attached to flexible PCB 200 so as to provide a matrix pattern on the back side of the glove.

According to an illustrative embodiment, the control circuit on flexible PCB 200 includes a voltage regulator 260, a microprocessor 215, a battery 275, a battery cover (not shown), a pushbutton on/off switch 285, a position sensor 220 (or motion and position sensor 220), a first power Metal Oxide Semiconductor Field Effect Transistor (MOSFET) 270, a second power MOSFET 205, and a third power MOSFET 210 are attached to flexible PCB 200 on the back side of glove 100. In a preferred embodiment, the aforementioned microprocessor 215 may be a PIC12Fxxx type microprocessor, such as that provided by Microchip Corporation, or any other similar microcontroller and the like. In a preferred embodiment, the aforementioned motion and position sensor 220 may be a mercury switch, a two-axis accelerometer, a weighted tilt switch, a Micro Electrical Mechanical System (MEMS) device, or any other similarly convenient means of simultaneously detecting the motion (or lack thereof) of glove 100 while at the same time detecting the position of glove 100 relative to the user.

In a preferred embodiment, one terminal of a first filter capacitor 235 is coupled to red high intensity LEDs 105 and green high intensity LEDs 110, and the other terminal of first filter capacitor is connected to ground. Similarly, one terminal of a second filter capacitor 255 is coupled to the connection between voltage regulator 260 and microprocessor 215, and the other terminal of second filter capacitor 255 is connected to ground. A third filter capacitor 265 is coupled between ground and the connection between the drain terminal of first power MOSFET 270 and voltage regulator 260. The drain terminal of first power MOSFET 270 is also coupled to red high intensity LEDs 105 and green high intensity LEDs 110. The gate terminal of first power MOSFET 270 is coupled to pushbutton on/off switch 285.

In a preferred embodiment, a Dual In-line Pin (DIP) connector 230 is coupled to microprocessor 215. DIP connector 230 enables a user of glove 100 to manually control the operation of red high intensity LEDs 105 and/or green high intensity LEDs 110. DIP connector 230 is connected to pushbutton on/off switch 285 via a diode 240 and a resistor 245. DIP connector 230 is thus also coupled to the gate terminal of first power MOSFET 270 via resistor 245. In one embodiment, a pull down resistor 250 is coupled between a terminal of resistor 245 and ground.

In a preferred embodiment, battery 275 is a removable 9-volt Direct Current (DC) power source. A pull-up resistor 280 is coupled between the positive terminal of battery 275 and a terminal of pushbutton on/off switch 285. The positive terminal of battery 275 is coupled directly to the source terminal of first power MOSFET 270. The negative terminal of battery 275 is connected to ground. The drain terminal of first power MOSFET 270 is coupled to an input terminal and an on/off terminal of voltage regulator 260. A ground terminal of voltage regulator 260 is connected to ground.

According to the illustrative embodiment, the gate terminal of second power MOSFET 205 is coupled to an output terminal of microprocessor 215. A pull-up resistor 204 is coupled between the gate terminal of second power MOSFET 205 and ground. Similarly, pull-up resistor 202 is coupled between the source terminal of second power MOSFET 205 and ground. The drain terminal of second power MOSFET 205 is coupled to red high intensity LEDs 105. Similarly, the drain terminal of third power MOSFET 210 is coupled to green high intensity LEDs 110, and the gate terminal of third power MOSFET 210 is coupled to an output terminal of microprocessor 215. A pull-up resistor 209 is coupled between the gate terminal of third power MOSFET 210 and ground. Pull-up resistor 207 is coupled between the source terminal of third power MOSFET 210 and ground.

As shown in FIG. 2, second power MOSFET 205 controls red LEDs 105 via an output I/O port pin located on microprocessor 215. Similarly, third power MOSFET 210 controls green LEDs 110 via a second output port pin located on microprocessor 215. First power MOSFET 270 controls the power flowing to voltage regulator 260 to microprocessor 215 and is in turn controlled by pushbutton on/off switch 285. Momentarily depressing pushbutton on/off switch 285 consequently applies a brief burst of power to voltage regulator 260 from battery 275. First power MOSFET 270, which is in parallel with momentary pushbutton on/off switch 285, is then turned on and current flows to microprocessor 215. In the preferred embodiment, voltage regulator 260 turns first power MOSFET 270 off and microprocessor 215 turns off both second power MOSFET 205 and third power MOSFET 210 after an extended period of time wherein no motion is detected by motion and position sensor 220, thereby turning off the power to all of LEDs 105 and 110.

When voltage regulator 260 is powered on and activates microprocessor 215, microprocessor 215 reads motion and position sensor 220 on a periodic basis (e.g., once every 50 milliseconds). In a preferred embodiment, motion and position sensor 220 is coupled to pull-up resistor 225, as shown in FIG. 2, wherein one end of pull-up resistor 225 is coupled a power source (e.g., the power output pin of voltage regulator 260) and the other end of the pull-up resistor is coupled to one pin of motion and position sensor 220 (e.g., a mercury switch), with the other pin of motion and position sensor 220 being coupled to an I/O port pin on microprocessor 215. In another embodiment, the other pin of pull-up resistor 225 may instead be connected to ground.

Motion and position sensor 220 may be positioned on glove 100 such that a connection between its pins is made only when the hand or arm of the user is positioned in a specific manner. In a preferred embodiment, the position of glove 100 in which a connection via motion and position sensor 220 is made (i.e., the mercury switch is closed) corresponds to the hand and arm of the user being extended outward relative to the front side of the body of the user, such that the arm is in a relatively horizontal position relative to the ground and the palm of the hand is in a vertical position with the fingers pointed skyward to within approximately 30 degrees of vertical relative to the ground. This position is commonly understood to mean "stop", especially when made by a policeman who is directing the flow of traffic. When the state of the motion and position sensor 220 corresponds to the palm side of the glove being in a vertical position with multiple fingers of the glove pointing skyward to within an acceptance angle of vertical relative to the ground, microprocessor 215 sends control signals to illuminate the high intensity red LEDs 105. In another embodiment, when the state of the motion and position sensor 220 corresponds to the palm side of the glove not being in a vertical position relative to the ground, microprocessor 215 illuminates the high intensity green LEDs 110.

In a preferred embodiment, microprocessor 215 monitors the state of motion and position sensor 220 on a periodic basis every 50 milliseconds. In alternate embodiments, microprocessor 215 may be programmed to perform multiple monitoring and/or lighting operations (e.g., blinking or other modulation patterns). For example, the glove may be monitored for additional motions such as dropping to a vertical position with the fingers pointing to the ground and respond by turning all LEDs off (e.g., when the user's arm is at his side).

In a preferred embodiment, any motion of the hand or arm of the user that places glove 100 outside of the position mentioned above, such that the fingers are no longer pointed skyward and are no longer within +/−30 degrees of vertical relative to the ground would cause the mercury in the switch to break the electrical contact between the pins of the mercury switch. As shown in FIG. 2, motion and position sensor 220 is connected to an I/O port pin on microprocessor 215. When the state of the motion and position sensor corresponds to the palm side of the glove 100 not being in a vertical position with multiple fingers of the glove 100 pointing skyward to within an acceptance angle of vertical relative to the ground, the microprocessor 215 sends control signals to deactivate the high intensity red LEDs 105. In a preferred embodiment, microprocessor 215 monitors motion and position sensor 220 to detect when the state of the motion and position sensor 220 indicates the palm side of the glove 100 is in a vertical position relative to the ground but is in motion. Microprocessor 215 detects motion of glove 100 by detecting breaks in electrical contact between pins of the mercury switch from motion and position sensor 220 connected to the I/O port pin on microprocessor 215 at a frequency of greater than once per second. Microprocessor 215 illuminates the high intensity green LEDs 110 and deactivates illumination of the led high intensity LEDs 105, when motion of the glove 100 is detected. Hysteresis or other threshold counts of the frequency can be incorporated into the program of microprocessor 215 to ensure casual movement of the glove not intended to be traffic direction does not illuminate the LEDs.

A commonly understood "go" signal includes the arm of the user being extended in a horizontal position relative to the ground, but with the palm of the hand facing toward the user and the hand moving back and forth relative to the user at an angle within approximately 30 degrees of vertical relative to the ground. Alternatively, a "go" signal may include the palm of the glove facing the user with the fingers pointing at an angle greater than approximately 30 degrees of vertical relative to the ground (i.e., sideways) while the arm of the user is bent at the elbow and moved back and forth and/or in a circular waving motion. In a preferred embodiment, the position of glove 100 in which a connection via motion and position sensor 220 is connected and broken at a frequency of greater than one per second (i.e., the mercury switch is opened and closed more than once per second) corresponds to the hand of the user being in a relatively vertical position with the fingers pointed skyward to within approximately 30 degrees of vertical relative to the ground and the hand being in motion, indicating a "go" signal to traffic.

Figure 3A:
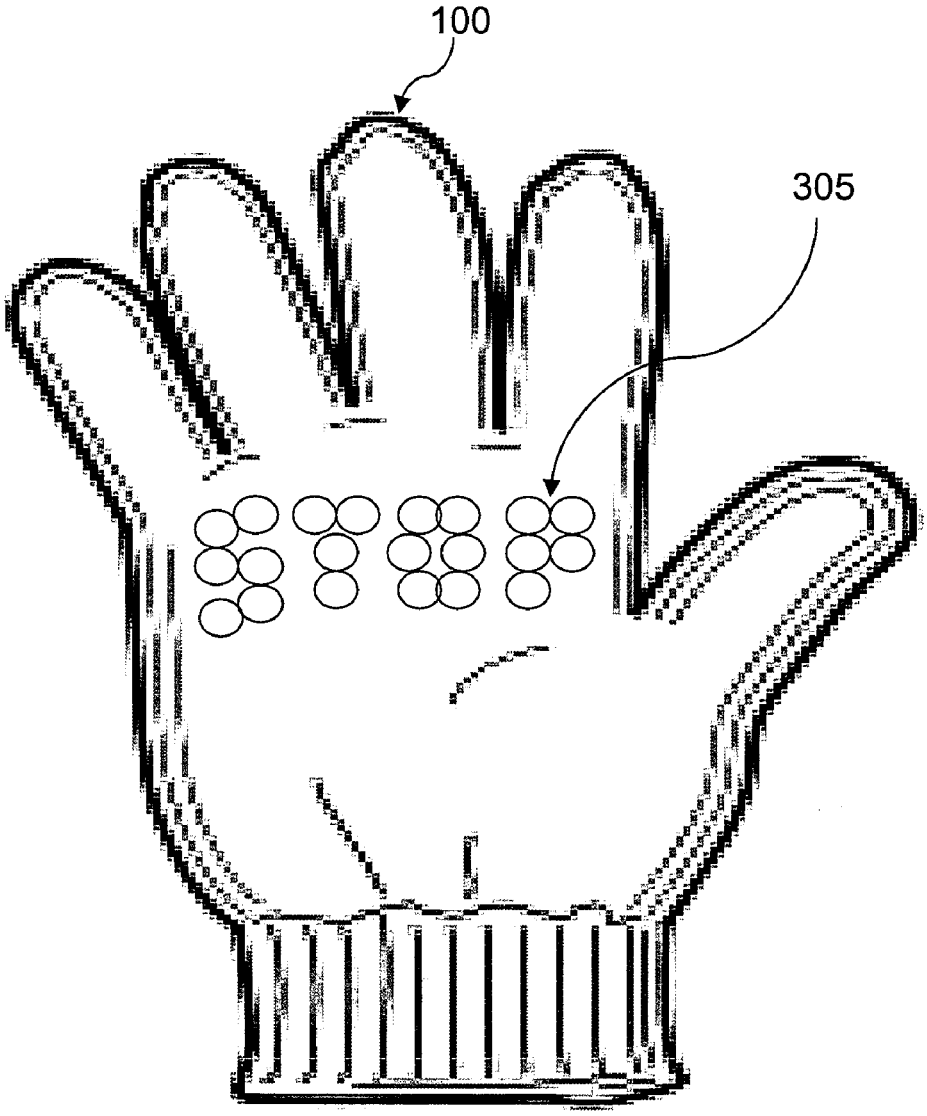
FIGS. 3A-3B depict an alternate embodiment of the invention in which the LEDs are configured in the shape of the words "STOP" on the front/palm of the glove and "GO" on the back of the glove, respectively.
Figure 3B:
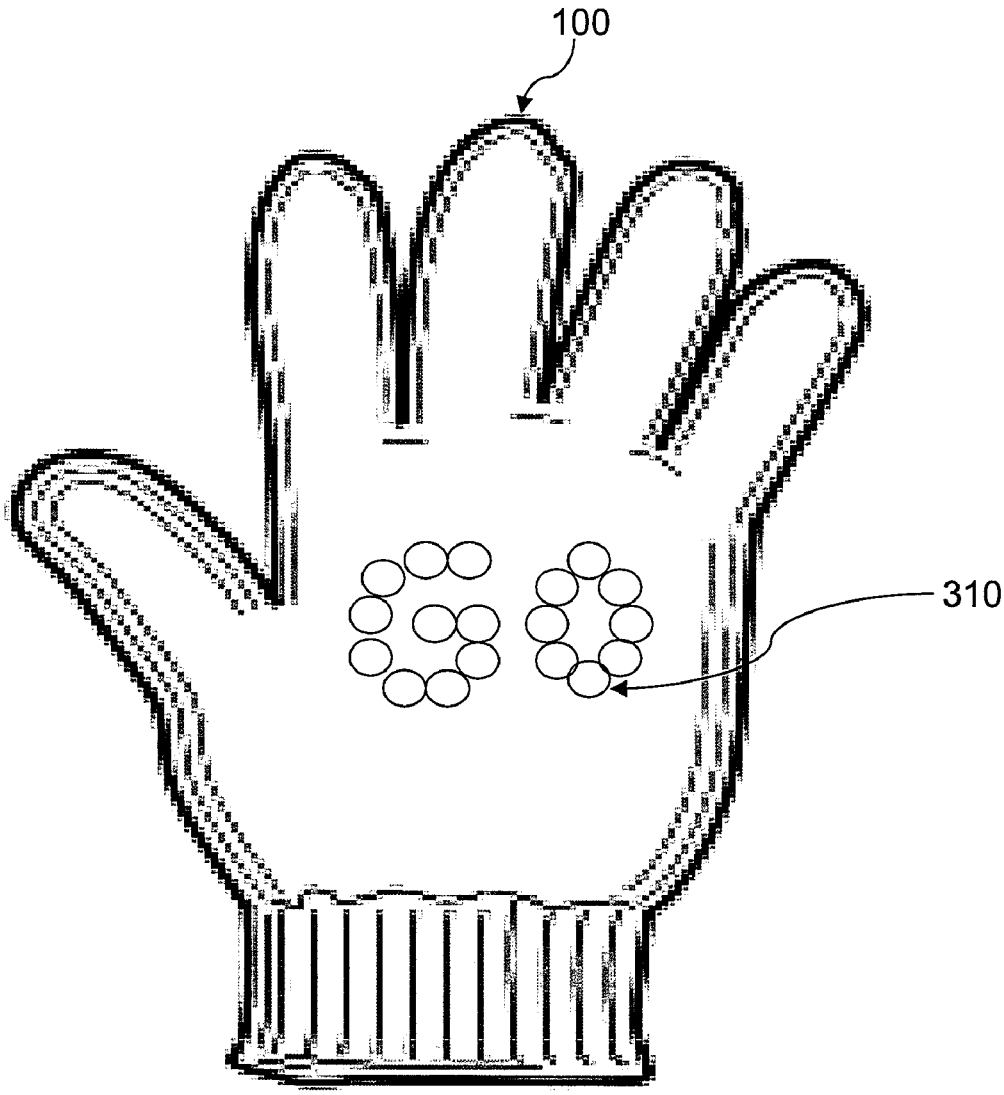

FIGS. 3A-3B depict an alternate embodiment of the invention, where the matrix pattern on the front/palm side and/or back side of glove 100 may be configured to form letters indicating traffic direction. As shown in FIG. 3A, red high intensity LEDs 305 on the front/palm side of glove 100 may be configured to form the word "STOP". As shown in FIG. 3B, multiple green high intensity LEDs 310 on the back side of glove 100 may be configured to form the word "GO". In alternate embodiments, the LEDs can be configured in any shape desired to visually communicate to traffic; for example, the LEDs can be configured in common designs such as the shape of a stop sign or other universal traffic control signal.

Figure 4A:
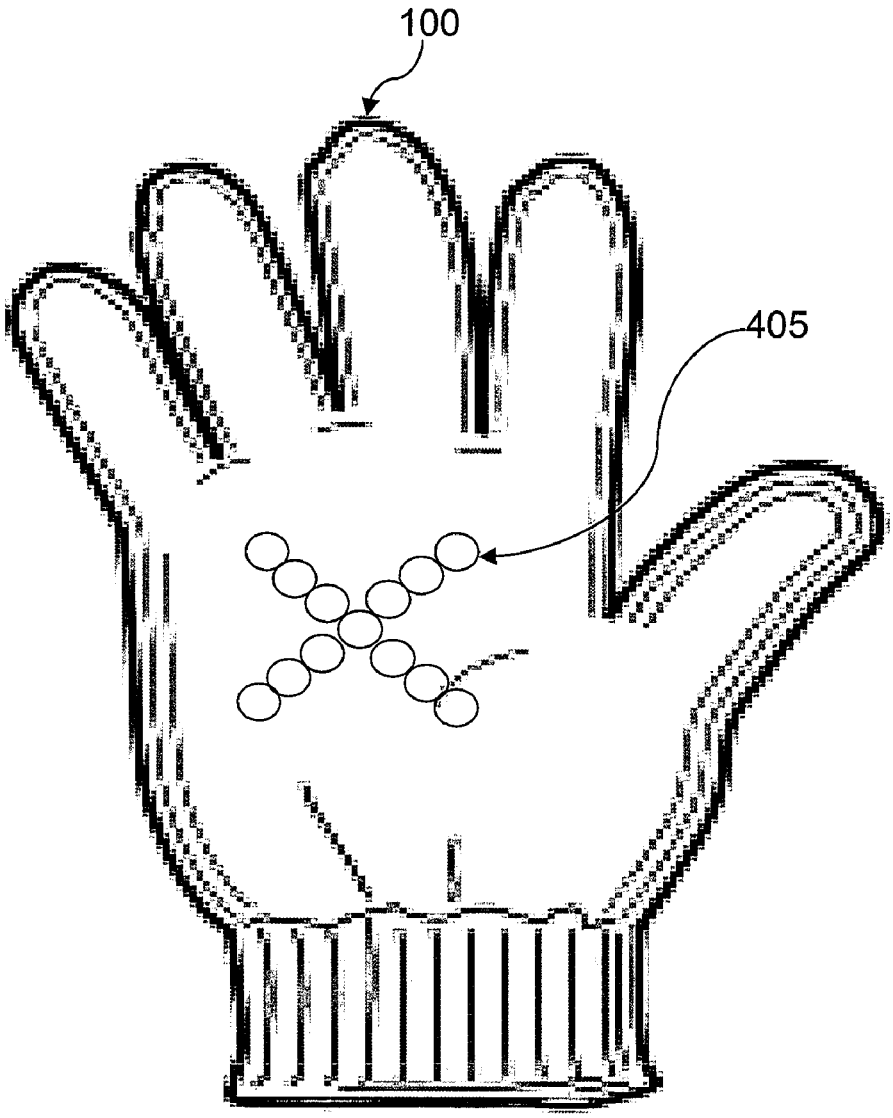
FIGS. 4A-4B depict an alternate embodiment of the invention in which the LEDs are configured in the shape of an "X" on the front/palm of the glove and an arrow on the back of the glove, respectively.
Figure 4B:
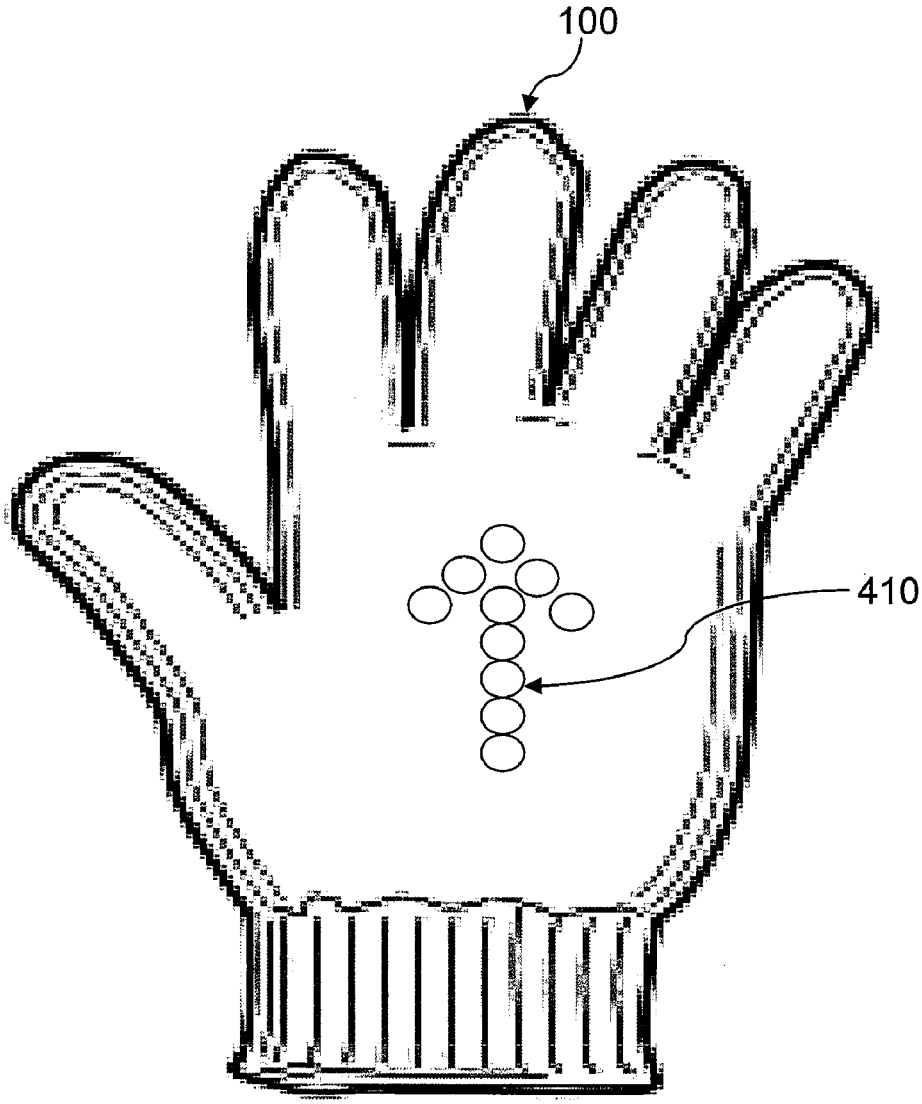

Similarly, FIGS. 4A-4B depict yet another embodiment of the invention, where the matrix pattern on the front/palm side and/or back side of glove 100 may be configured to form symbols indicating traffic direction. As shown in FIG. 4A, multiple red high intensity LEDs 405 on the front/palm side of glove 100 may be configured to form an "X" symbol (i.e., a symbol that corresponds to a "stop" command). As shown in FIG. 4B, multiple green high intensity LEDs 410 on the back side of glove 100 may be configured to form an arrow (i.e., a symbol that corresponds to a "go" command).

The preferred embodiment thus provides a hand-held electronic apparatus for directing the flow of traffic. The palm side of glove 100 includes multiple high intensity red LEDs 105, and the back side of glove 100 includes multiple high intensity green LEDs 110. A control circuit coupled to high intensity red LEDs 105 and high intensity green LEDs 110 periodically monitors the state of motion and position sensor 220, which is connected to glove 100. When the state of motion and position sensor 220 corresponds to the palm side of glove 100 being extended outward from the user in a vertical position relative to the ground, wherein a vertical position is defined as multiple fingers of glove 100 pointing skyward to within an acceptance angle (i.e., 30 degrees) of vertical relative to the ground and where the glove is in a relative state of motionlessness, the control circuit illuminates high intensity red LEDs 105 and deactivates high intensity green LEDs 110. When the state of motion and position sensor 220 corresponds to the palm side of glove 100 not being in a vertical position relative to the ground facing away from the user (e.g., a sideways and/or circular waving motion in the direction of the user), the control circuit illuminates high intensity green LEDs 110 and deactivates high intensity red LEDs 105.

It is understood that the use herein of specific names are for example only and not meant to imply any limitations on the invention. The invention may thus be implemented with different nomenclature/terminology and associated functionality utilized to describe the above devices/utility, etc., without limitation. While the invention has been particularly shown and described with reference to a preferred embodiment, it will be understood by those skilled in the art that various changes in form and detail may be made therein without departing from the spirit and scope of the invention.

What is claimed is:

1. An apparatus comprising:

a mounting structure suitable to be held or attached to a hand;

one or more lights located on a side of said mounting structure configured to signal vehicular traffic when illuminated;

a position sensor; and a control circuit coupled to said one or more lights and said position sensor, wherein said control circuit operates to:

monitor a state of said position sensor;

in response to a determination that said state of said position sensor corresponds to said side being in a vertical position within a preselected tolerance, selectively illuminating one or more of said one or more lights; and in response to a determination that said state of said position sensor corresponds to said side not being in a vertical position within said preselected tolerance, selectively deactivating illumination of said one or more lights.

2. The apparatus of claim 1, wherein the one or more lights are red light emitting diodes (LEDs).

3. The apparatus of claim 1, wherein the mounting structure is a glove.

4. The apparatus of claim 3, wherein said vertical position comprises a plurality of fingers of said glove pointing skyward to within a selected angle of vertical relative to the ground.

5. The apparatus of claim 3, wherein the one or more lights comprises:

a plurality of red high intensity LEDs configured in an array on a palm side of said glove and a plurality of green high intensity LEDs configured in an array on a back side of said glove.

6. The apparatus of claim 5, wherein the control circuit operates to deactivate said plurality of green high intensity LEDs when said red high intensity LEDs are activated.

7. The apparatus of claim 1, wherein said position sensor indicates motion and said control circuit responds to an indication of motion by said position sensor by selectively illuminating said one or more lights.

8. The apparatus of claim 1, wherein said one or more lights are configured to form a "STOP" text on a palm side of a glove and configured to form a "GO" text on a back side of a glove.

9. The apparatus of claim 1, wherein said position sensor comprises a mercury switch.

10. The apparatus of claim 1, wherein said position sensor comprises a Micro Electrical Mechanical System (MEMS) device.

11. The apparatus of claim 1, wherein said monitoring said state of said position sensor further comprises determining said state every 50 milliseconds.

12. A method comprising:

monitoring a state of a motion and position sensor within a control circuit, wherein said control circuit is attached to a glove and said glove comprises a plurality of high intensity red light emitting diodes (LEDs) coupled to said control circuit, wherein said plurality of high intensity red LEDs are located on a first side of said glove;

in response to a determination that said state of said motion and position sensor corresponds to said first side of said glove being in a vertical position, wherein said vertical position comprises a plurality of fingers of said glove pointing skyward to within an acceptance angle of vertical relative to the ground, illuminating said plurality of high intensity red LEDs; and in response to a determination that said state of said motion and position sensor corresponds to said first side of said glove not being in a vertical position relative to the ground, deactivating said plurality of high intensity red LEDs.

13. The method of claim 12, wherein said glove includes a plurality of high intensity green LEDs coupled to said control circuit, wherein said plurality of high intensity green LEDs are located on a second side of said glove and further comprising deactivating said plurality of high intensity green LEDs in response to a determination that said state of said motion and position sensor corresponds to said first side of said glove being in a vertical position, and in response to a determination that said state of said motion and position sensor corresponds to said first side of said glove not being in a vertical position relative to the ground, illuminating said plurality of high intensity green LEDs.

14. The method of claim 12, wherein said plurality of red high intensity LEDs are configured in an array on said first side of said glove and said plurality of green high intensity LEDs are configured in an array on said back side of said glove.

15. The method of claim 12, wherein said plurality of red high intensity LEDs are configured to form a "STOP" text on said first side of said glove and said plurality of green high intensity LEDs are configured to form a "GO" text on said back side of said glove.

16. The method of claim 12, wherein said plurality of red high intensity LEDs are configured to form an "X" symbol on said first side of said glove and said plurality of green high intensity LEDs are configured to form an arrow symbol on said back side of said glove.

17. The method of claim 12, wherein said motion and position sensor further comprises a mercury switch.

18. The method of claim 12, wherein said motion and position sensor further comprises a Micro Electrical Mechanical System (MEMS) device.

19. The method of claim 12, wherein said monitoring said state of said motion and position sensor further comprises determining said state every 50 milliseconds.

20. The method of claim 12, wherein said glove comprises a plurality of high intensity green LEDs coupled to said control circuit, wherein said plurality of high intensity green LEDs are located on a first side of said glove, further comprising, in response to a determination that said state of said motion and position sensor corresponds to said glove being in motion while oriented in a particular position, illuminating said plurality of high intensity green LEDs.

* * * * *